US007590523B2

(12) United States Patent
Gao

(10) Patent No.: US 7,590,523 B2
(45) Date of Patent: Sep. 15, 2009

(54) SPEECH POST-PROCESSING USING MDCT COEFFICIENTS

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 610 days.

(21) Appl. No.: 11/385,428

(22) Filed: Mar. 20, 2006

(65) Prior Publication Data

US 2007/0219785 A1 Sep. 20, 2007

(51) Int. Cl.
*G10L 19/14* (2006.01)
*G10L 19/02* (2006.01)

(52) U.S. Cl. ..... 704/200.1; 704/205; 704/228

(58) Field of Classification Search ..... 704/200, 704/203, 228, E21.002, 200.1, 205; 708/400, 708/402

See application file for complete search history.

(56) References Cited

U.S. PATENT DOCUMENTS 4,454,609 A * 6/1984 Kates ..... 381/320
4,630,305 A * 12/1986 Borth et al. ..... 381/94.3
5,247,579 A * 9/1993 Hardwick et al. ..... 704/230
5,630,011 A * 5/1997 Lim et al. ..... 704/205
5,684,920 A * 11/1997 Iwakami et al. ..... 704/203
5,752,222 A * 5/1998 Nishiguchi et al. ..... 704/201
5,812,971 A * 9/1998 Herre ..... 704/230
5,864,798 A * 1/1999 Miseki et al. ..... 704/225
6,067,511 A * 5/2000 Grabb et al. ..... 704/223
6,138,093 A * 10/2000 Ekudden et al. ..... 704/228
6,182,030 B1 * 1/2001 Hagen et al. ..... 704/201
6,502,069 B1 * 12/2002 Grill et al. ..... 704/219
6,941,263 B2 9/2005 Wang et al.
7,146,316 B2 * 12/2006 Alves ..... 704/233
7,272,556 B1 * 9/2007 Aguilar et al. ..... 704/230
7,356,748 B2 * 4/2008 Taleb ..... 714/746
2002/0087304 A1 * 7/2002 Kjorling et al. ..... 704/219
2003/0009326 A1 * 1/2003 Wang et al. ..... 704/219
2003/0097256 A1 * 5/2003 Kleijn ..... 704/207
2004/0117177 A1 * 6/2004 Kjorling et al. ..... 704/225

(Continued)

OTHER PUBLICATIONS

T.-H. Tsai, Y.-C. Yang, and C.-N. Liu, "A Hardware/Software Co-Design of MP3 Audio Decoder," The Journal of VLSI Signal Processing, vol. 41, No. 1, pp. 111-127, Aug. 2005.*

(Continued)

*Primary Examiner*—Talivaldis Ivars Smits
*Assistant Examiner*—Greg A Borsetti
(74) *Attorney, Agent, or Firm*—Farjami & Farjami LLP

(57) ABSTRACT

There is provided a speech post-processor for enhancing a speech signal divided into a plurality of sub-bands in frequency domain. The speech post-processor comprises an envelope modification factor generator configured to use frequency domain coefficients representative of an envelope derived from the plurality of sub-bands to generate an envelope modification factor for the envelope derived from the plurality of sub-bands, where the envelope modification factor is generated using $FAC=\alpha ENV/Max+(1-\alpha)$, where FAC is the envelope modification factor, ENV is the envelope, Max is the maximum envelope, and $\alpha$ is a value between 0 and 1, where $\alpha$ is a different constant value for each speech coding rate. The speech post-processor further comprises an envelope modifier configured to modify the envelope derived from the plurality of sub-bands by the envelope modification factor corresponding to each of the plurality of sub-bands.

10 Claims, 6 Drawing Sheets

U.S. PATENT DOCUMENTS

| | | | | |
|---|---|---|---|---|
| 2004/0184537 | A1 | 9/2004 | Geiger et al. | |
| 2005/0163234 | A1* | 7/2005 | Taleb | 375/259 |
| 2006/0020450 | A1 | 1/2006 | Miseki | |
| 2006/0116874 | A1* | 6/2006 | Samuelsson et al. | 704/228 |
| 2006/0293882 | A1* | 12/2006 | Giesbrecht et al. | 704/204 |

OTHER PUBLICATIONS

J. Yang, F. Luo, and A. Nehorai, "Spectral contrast enhancement: Algorithms and comparisons," Speech Commun., vol. 39, Jan. 2003.

[12] T. Painter and A. Spanias, "Perceptual coding of digital audio," Proc. IEEE, vol. 88, No. 4, pp. 451-515, Apr. 2000.*

J. H. Chen and A. Gersho, "Adaptive postfiltering for quality enhancement of coded speech," IEEE Trans. Speech Audio Processing, vol. 3, pp. 59-71, 1995.*

Xiang J, Wang Y, Simon JZ (2005) MEG Responses to Speech and Stimuli With Speechlike Modulations. In: International IEEE EMBS Conference on Neural Engineering 2005.*

A. J. S. Ferreira and D. Sinha, "Accurate Spectral Replacement," 118th Convention of the Audio Engineering Society, May 2005, paper 6383.*

W. B. Kleijn "Enhancement of coded speech by constrained optimization," Proc. IEEE Workshop Speech Coding, 2002, p. 163.*

*Coding of Speech at 8 kbit/s Using Conjugate-Structure Algebraic-Code-Excited Linear-Prediction* (*CS-ACELP*), International Telecommunication Union, ITU-T Recommendation G.729, 1-35 (Mar. 1996).

* cited by examiner

SPEECH POST-PROCESSING USING MDCT COEFFICIENTS

BACKGROUND OF THE INVENTION

1. Field of the Invention

The present invention relates generally to speech coding. More particularly, the present invention relates to speech post-processing.

2. Background Art

Speech compression may be used to reduce the number of bits that represent the speech signal thereby reducing the bandwidth needed for transmission. However, speech compression may result in degradation of the quality of decompressed speech. In general, a higher bit rate will result in higher quality, while a lower bit rate will result in lower quality. However, modern speech compression techniques, such as coding techniques, can produce decompressed speech of relatively high quality at relatively low bit rates. In general, modern coding techniques attempt to represent the perceptually important features of the speech signal, without preserving the actual speech waveform. Speech compression systems, commonly called codecs, include an encoder and a decoder and may be used to reduce the bit rate of digital speech signals. Numerous algorithms have been developed for speech codecs that reduce the number of bits required to digitally encode the original speech while attempting to maintain high quality reconstructed speech.

FIG. 1 illustrates conventional speech decoding system 100, which includes excitation decoder 110, synthesis filter 120 and post-processor 130. As shown, decoding system 100 receives encoded speech bitstream 102 over a communication medium (not shown) from an encoder, where decoding system 100 may be part of a mobile communication device, a base station or other wireless or wireline communication device that is capable of receiving encoded speech bitstream 102. Decoding system 100 operates to decode encoded speech bitstream 102 and generate speech signal 132 in the form of a digital signal. Speech signal 132 may then be converted to an analog signal by a digital-to-analog converter (not shown). The analog output of the digital-to-analog converter may be received by a receiver (not shown) that may be a human ear, a magnetic tape recorder, or any other device capable of receiving an analog signal. Alternatively, a digital recording device, a speech recognition device, or any other device capable of receiving a digital signal may receive speech signal 132.

Excitation decoder 110 decodes encoded speech bitstream 102 according to the coding algorithm and bit rate of encoded speech bitstream 102, and generates decoded excitation 112. Synthesis filter 120 may be a short-term inverse prediction filter that generates synthesized speech 122 based on decoded excitation 112. Post-processor 130 may include filtering, signal enhancement, noise modification, amplification, tilt correction and other similar techniques capable of improving the perceptual quality of synthesized speech 122. Post-processor 130 may decrease the audible noise without noticeably degrading synthesized speech 122. Decreasing the audible noise may be accomplished by emphasizing the formant structure of synthesized speech 122 or by suppressing the noise in the frequency regions that are perceptually not relevant for synthesized speech 122.

Conventionally, post-processing of synthesized speech 122 is performed in the time domain using available LPC (Linear Prediction Coding) parameters. However, when such LPC parameters are not available, it is too costly, in terms of complexity and code size, to generate LPC parameters for the purpose of post-processing of synthesized speech 122. This is especially true for wideband post-processing of synthesized speech 122. Accordingly, there is a strong need in the art for a decoder post-processor that can perform efficiently and effectively without utilizing time domain post-processing based on LPC parameters.

SUMMARY OF THE INVENTION

The present invention is directed to a speech post-processor for enhancing a speech signal divided into a plurality of sub-bands in frequency domain. In one aspect, the speech post-processor comprises an envelope modification factor generator configured to use frequency domain coefficients representative of an envelope derived from the plurality of sub-bands to generate an envelope modification factor for the envelope derived from the plurality of sub-bands. The speech post-processor further comprises an envelope modifier configured to modify the envelope derived from the plurality of sub-bands by the envelope modification factor corresponding to each of the plurality of sub-bands.

In a further aspect, the envelope modification factor generator generates the envelope modification factor using $FAC=\alpha ENV/Max+(1-\alpha)$, where FAC is the envelope modification factor, ENV is the envelope, Max is the maximum envelope, and $\alpha$ is a value between 0 and 1. Further, $\alpha$ may be a first constant value for a first speech coding rate ($\alpha\mathbf{1}$), and $\alpha$ may be a second constant value for a second speech coding rate ($\alpha\mathbf{2}$), where the second speech coding rate is higher than the first speech coding rate, and $\alpha\mathbf{1}>\alpha\mathbf{2}$. In addition, the frequency domain coefficients may be MDCT (Modified Discrete Cosine Transform).

In yet another aspect, the envelope modifier modifies the envelope derived from the plurality of sub-bands by multiplying each of the envelope modification factor with its corresponding envelope.

In an additional aspect, the speech post-processor further comprises a fine structure modification factor generator configured to use frequency domain coefficients representative of a plurality of fine structures of each of the plurality of sub-bands to generate a fine structure modification factor for the plurality of fine structures of each of the plurality of sub-bands, and a fine structure modifier configured to modify the plurality of fine structures of each of the plurality of sub-bands by the fine structure modification factor corresponding to each of the plurality of fine structures.

In such aspect, the fine structure modification factor generator may generate the fine structure modification factor using $FAC=\beta MAG/Max+(1-\beta)$, where FAC is the fine structure modification factor, MAG is a magnitude, Max is the maximum magnitude, and $\beta$ is a value between 0 and 1.

In a further aspect, $\beta$ may be a first constant value for a first speech coding rate ($\beta\mathbf{1}$), and $\beta$ may be a second constant value for a second speech coding rate ($\beta\mathbf{2}$), where the second speech coding rate is higher than the first speech coding rate, and $\beta\mathbf{1}>\beta\mathbf{2}$.

Other features and advantages of the present invention will become more readily apparent to those of ordinary skill in the art after reviewing the following detailed description and accompanying drawings.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

Figure 1:
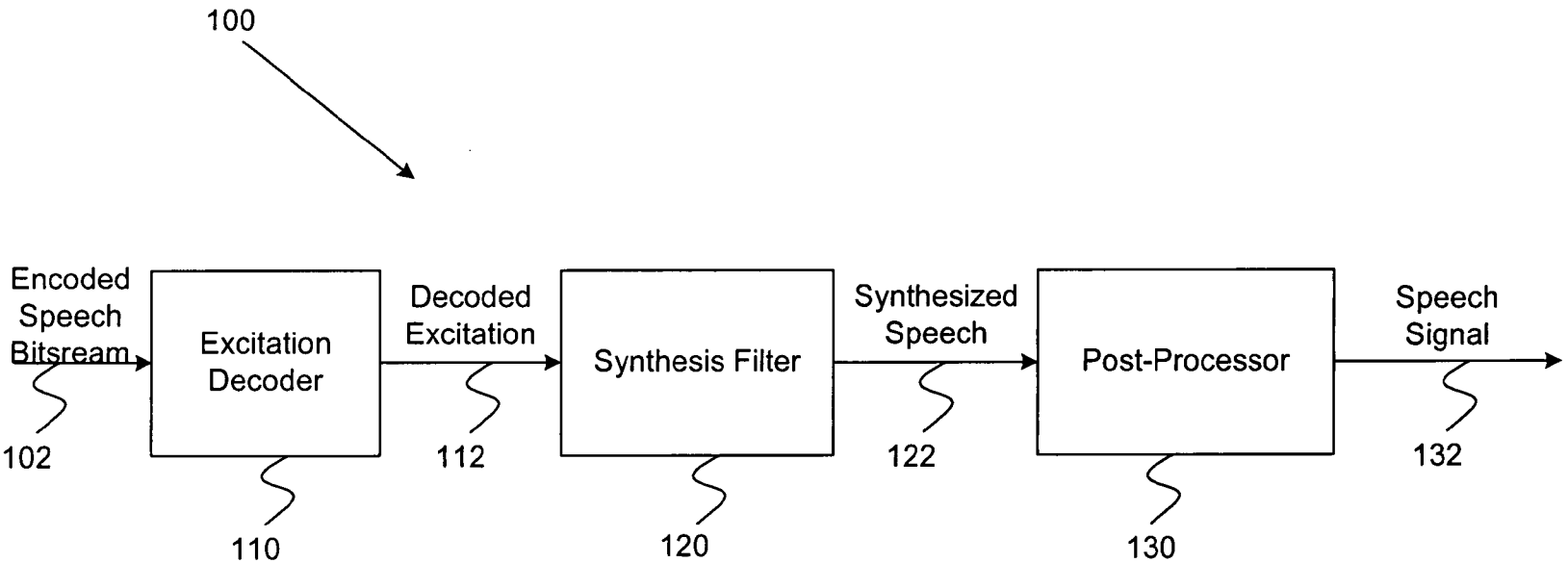
FIG. 1 (PRIOR ART)
FIG. 1 illustrates a block diagram of a conventional decoding system for decoding and post-processing of encoded speech signal.

Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely example embodiments of the invention. To maintain brevity, other embodiments of the invention which use the principles of the present invention are not specifically described in the present application and are not specifically illustrated by the present drawings. It should be borne in mind that, unless noted otherwise, like or corresponding elements among the figures may be indicated by like or corresponding reference numerals.

Figure 2A:
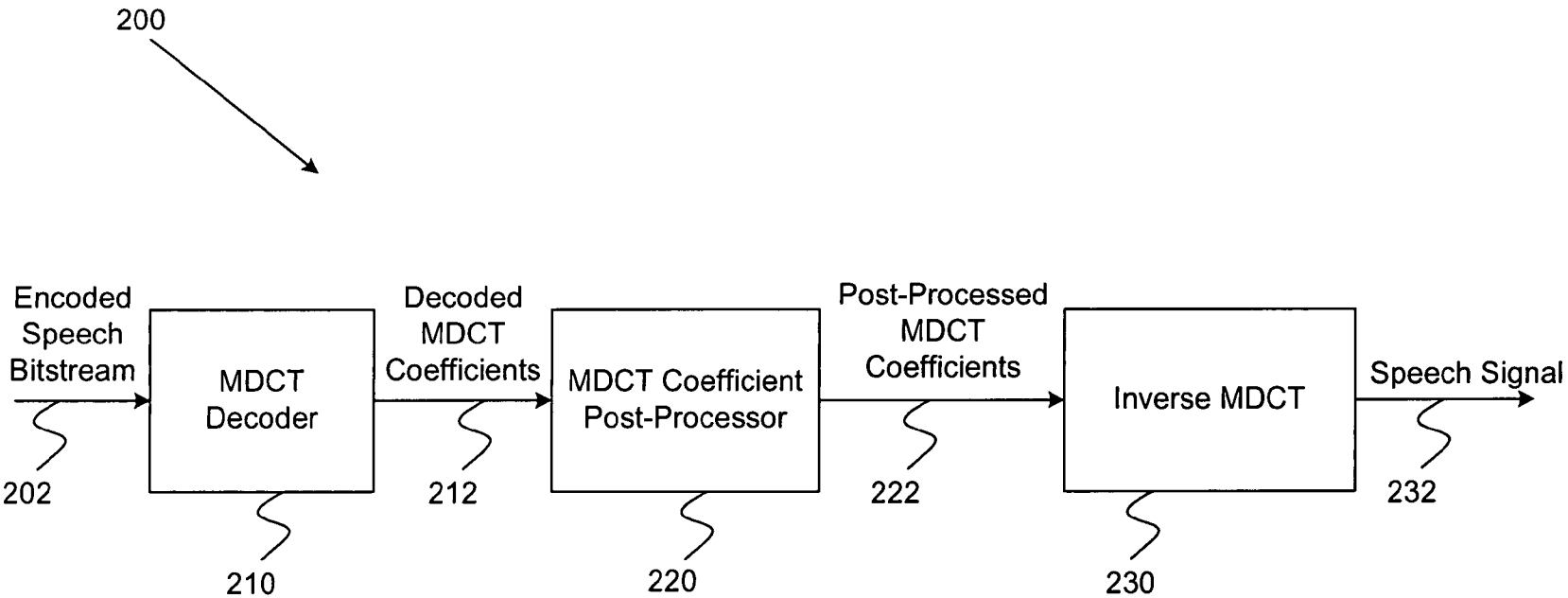
FIG. 2A illustrates a block diagram of a decoding system for decoding and post-processing of encoded speech signal, according to one embodiment of the present invention.

FIG. 2A illustrates a block diagram of decoding system 200 for decoding and post-processing of encoded speech signal, according to one embodiment of the present invention. As shown, decoding system 200 includes MDCT decoder 210, MDCT coefficient post-processor 220 and inverse MDCT 230. Decoding system 200 receives encoded speech bitstream 202 over a communication medium (not shown) from an encoder or from a storage medium, where decoding system 200 may be part of a mobile communication device, a base station or other wireless or wireline communication device that is capable of receiving encoded speech bitstream 202. Decoding system 200 operates to decode encoded speech bitstream 202 and generate speech signal 232 in the form of a digital signal. Speech signal 232 may then be converted to an analog signal by a digital-to-analog converter (not shown). The analog output of the digital-to-analog converter may be received by a receiver (not shown) that may be a human ear, a magnetic tape recorder, or any other device capable of receiving an analog signal. Alternatively, a digital recording device, a speech recognition device, or any other device capable of receiving a digital signal may receive speech signal 232.

MDCT decoder 210 decodes encoded speech 212 according to the coding algorithm and bit rate of encoded speech bitstream 202, and generates decoded MDCT coefficients 212. MDCT coefficient post-processor operates on decoded MDCT coefficients 212 to generate post-processed MDCT coefficients 222, which decrease the audible noise without noticeably degrading speech quality. As discussed below in conjunction with FIG. 2B, decreasing the audible noise may be accomplished by modifying the envelope and fine structures of the signal using MDCT coefficients. Inverse MDCT 230 combines post-processed envelope and post-processed fine structure, for example by multiplying post-processed envelope with post-processed fine structure, for reconstruction of the MDCT coefficients, and generates speech signal 232.

Figure 2B:
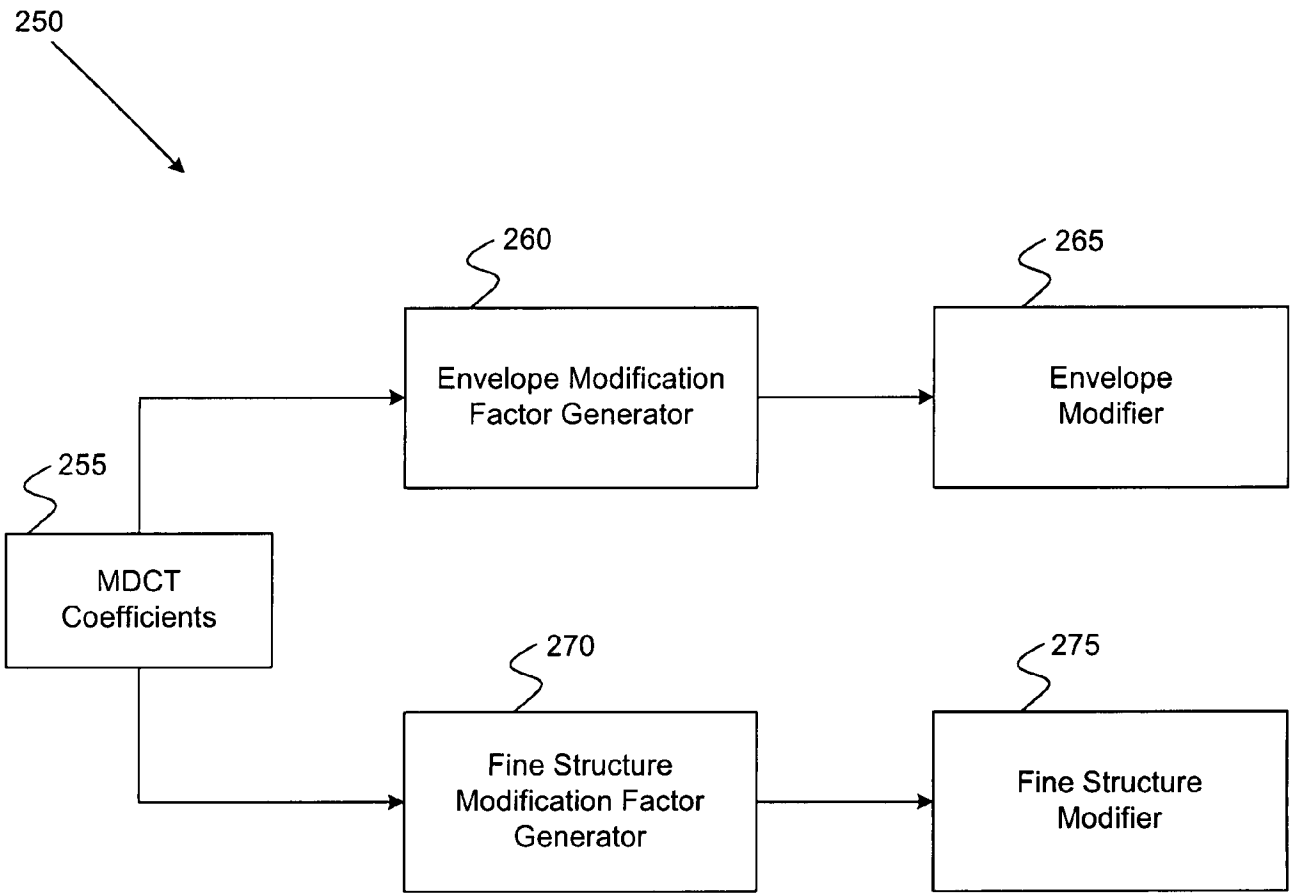
FIG. 2B illustrates a block diagram of a post-processor, according to one embodiment of the present invention.

FIG. 2B illustrates a block diagram of post-processor 250, according to one embodiment of the present invention. Unlike conventional post-processors that operate in time-domain, post-processor 250 operates in frequency domain. In its preferred embodiment, the present invention utilizes MDCT or TDAC (Time Domain Aligned Cancellation) coefficients in frequency domain. Although the present invention may also use DFT (Discrete Fourier Transform) or FFT (Fast Fourier Transform) in frequency domain for post-processing of the synthesized speech, due to potential discontinuity from one frame to the next at frame boundaries, DFT and FFT are less favored. The frame discontinuity may be created by using DFT or FFT to decompose the speech signal into two signals and a subsequent addition. However, in the preferred embodiment of the present invention, post-processor 250 utilizes the MDCT coefficients and the speech signal is decomposed into two signals with overlapping windows, where windows of the speech signal are cosine transformed and quantized in frequency domain, and when transformed back to time domain, an overlap-add operation is performed to avoid discontinuity between the frames.

As shown in FIG. 2B, post-processor 250 receives or generates MDCT coefficients at block 210, which are known to those of ordinary skill in the art. In one embodiment, post-processor 250 performs envelope post-processing at envelope modification factor generator 260 and envelope modifier 265 by reducing the energy in spectral envelope valley areas while substantially maintaining overall energy and spectral tilt of the speech signal. Further, post-processor 250 may perform fine structure post-processing at fine structure modification factor generator 270 and fine structure modifier 275 by diminishing the spectral magnitude between harmonics, if any, of the speech signal.

Figure 3:
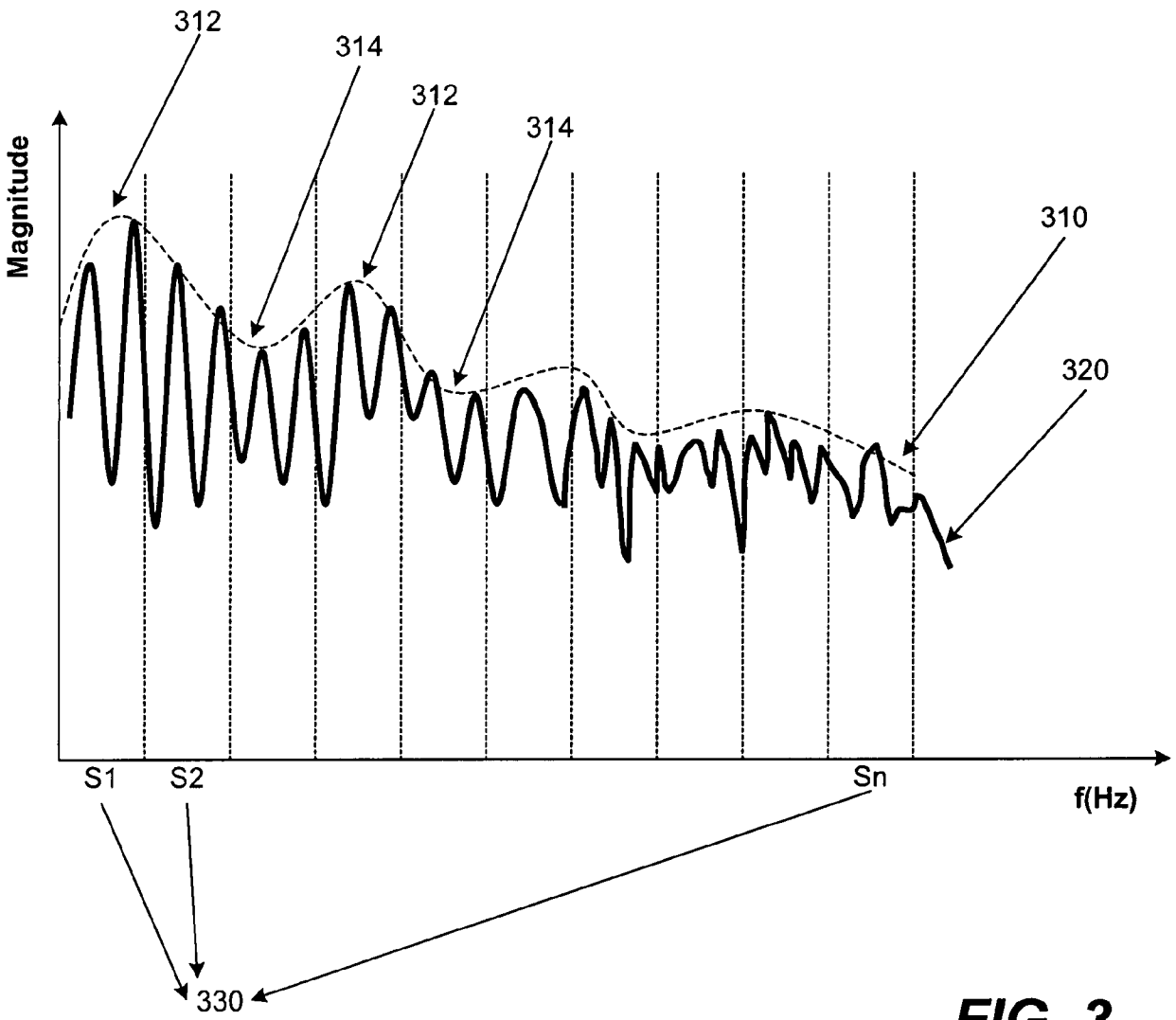
FIG. 3 illustrates a representation of an envelope of the speech signal for envelope post-processing of the synthesized speech, according to one embodiment of the present invention.

Sub-band modification factor generator 260 divides the frequency range into a plurality of frequency sub-bands, shown in FIG. 3 as sub-bands S1, S2, . . . Sn 300. The frequency range for each sub-band may be the same or may vary from one sub-band to another. In one embodiment, each sub-band should include at least one harmonic peak to ensure that each sub-band is not too small. Next, sub-band modification factor generator 260 estimates a plurality of values based on the MDCT coefficients to represent envelope 310 for speech signal 320.

As an example, the entire frequency range may be divided into a number of sub-bands, such as ten (10), and a number of values, such as ten (10), are estimated for representing the envelope derived from each sub-band, where the envelope is represented by:

$$ENV[i],\ i=0,1,2,\ldots,23 \qquad \text{Equation 1.}$$

Next, sub-band modification factor generator 260 generates a modification factor using the following equation:

$$FAC[i]=\alpha ENV[i]/Max+(1-\alpha),\ i=0,1,2,\ldots,23 \qquad \text{Equation 2,}$$

where Max is the maximum envelope value, and $\alpha$ is a constant value between 0 and 1, which controls the degree of envelope modification. In one embodiment, $\alpha$ can be a constant value between 0 and 0.5, such as 0.25. Although the value of $\alpha$ may be constant for each bit rate, the value of $\alpha$ may vary based on the bit rate. In such embodiments, for a higher bit rate, the value of $\alpha$ is smaller than the value of $\alpha$ for a lower bit rate. The smaller the value of $\alpha$, the lesser the modification of envelope. For example, in one embodiment, the value of $\alpha$ is constant ($\alpha=\alpha\mathbf{1}$) for 14 Kbps, and the value of $\beta$ is constant ($\alpha=\alpha\mathbf{2}$) for 28 Kbps, but $\alpha\mathbf{1}>\alpha\mathbf{2}$.

In one embodiment, envelope modifier 265 modifies envelope 310 by multiplying envelope 320 with the factor generated by sub-band modification factor generator 260, as shown below:

$$ENV'[i]=ENV[i]\cdot FAC[i],\ i=0,1,2,\ldots,23 \qquad \text{Equation 3.}$$

Accordingly, FAC[i] modifies the energy of each sub-band, where FAC[i] is less than one (1). For larger peak energy areas, FAC[i] is closer to one, and for smaller peak energy areas, FAC[i] is closer to zero.

It is known that distortions of the speech signal occur more at low bit rates, and mostly at valley areas 314 rather than formant areas 312, where the ratio of signal energy to quantization error is higher. By utilizing the MDCT coefficients, FAC[i] is calculated for modifying ENV[i] by reducing the energy in spectral envelope valley areas 314 while substantially maintaining overall energy and spectral tilt of the speech signal.

Figure 4:
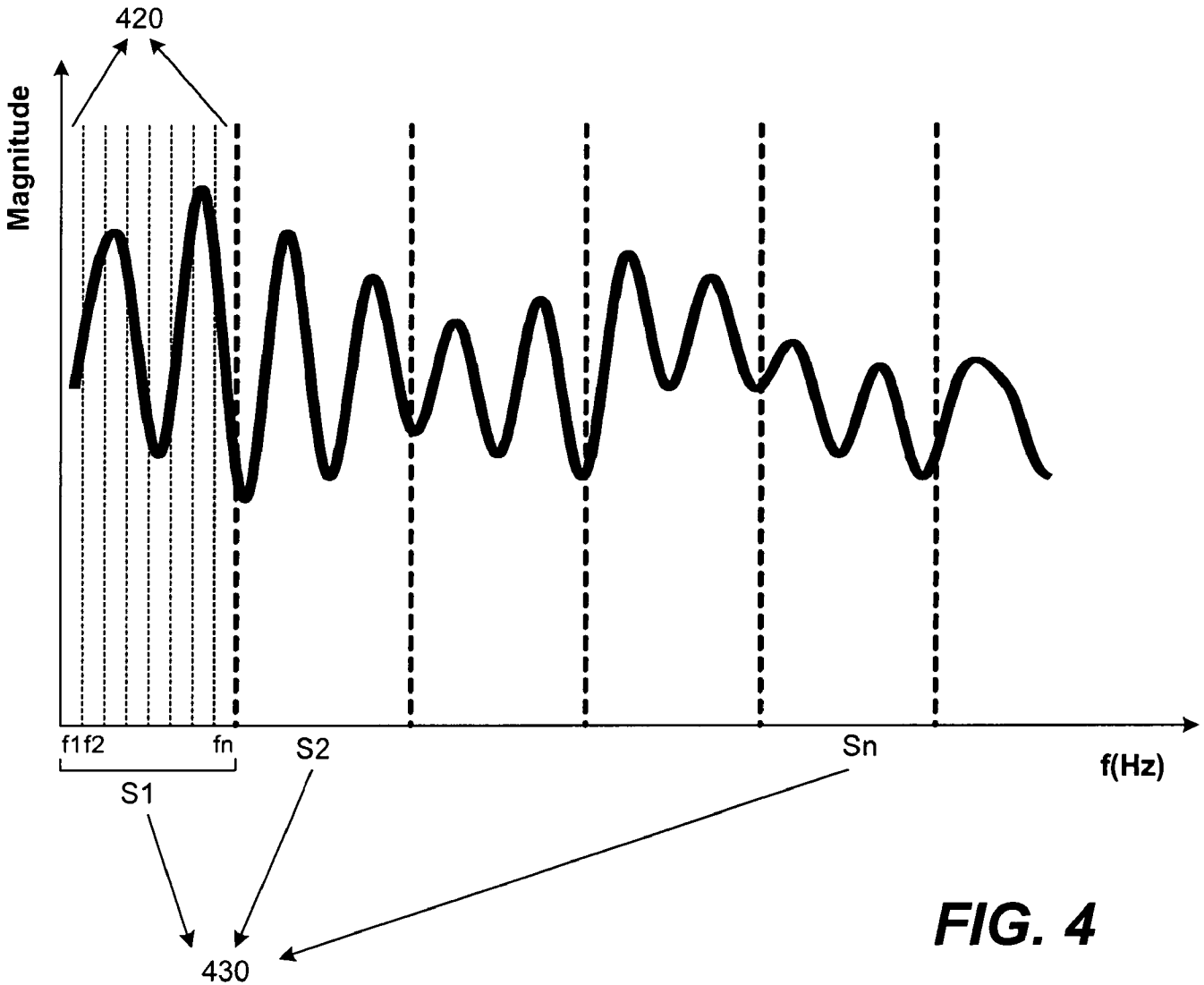
FIG. 4 illustrates a representation of fine structures of the speech signal for fine structure post-processing of the synthesized speech, according to one embodiment of the present invention.

Turning to FIG. 4, fine structure modification factor generator 270 further focuses on the fine structures, e.g. frequencies f1, f2, . . . , fn 420, within each of the plurality of frequency sub-bands, shown in FIG. 4 as sub-bands S1, S2, . . . Sn 430. For example, the above procedures applied to each sub-band S1, S2, . . . , Sn 330 in sub-band modification factor generator 260 and envelope modifier 265 are applied to each f1, f2, . . . , fn 420 in fine structure modification factor generator 270 and fine structure modifier 275, respectively. As in the envelope post-processing procedure discussed above, the modification factor for the fine structures or the magnitude (MAG) of MDCT coefficients within each of the plurality of sub-bands can be obtained using an equation similar to that of Equation 2, as shown below:

$$FAC[i]=\beta MAG[i]/Max+(1-\beta) \qquad \text{Equation 4,}$$

where Max is the maximum magnitude, and $\beta$ is a constant value between 0 and 1, which controls the degree of magnitude or fine structure modification. Although the value of $\beta$ may be constant for each bit rate, the value of $\beta$ may vary based on the bit rate. In such embodiments, for a higher bit rate, the value of $\beta$ is smaller than the value of $\beta$ for a lower bit rate. The smaller the value of $\beta$, the lesser the modification of fine structures. For example, in one embodiment, the value of $\beta$ is constant ($\beta=\beta\mathbf{1}$) for 14 Kbps, and the value of $\beta$ is constant ($\beta=\beta\mathbf{2}$) for 28 Kbps, but $\beta\mathbf{1}>\beta\mathbf{2}$. As a result, fine structure modification factor generator 270 and fine structure modifier 275 diminish the spectral magnitude between harmonics, if any. Next, a reconstruction of post-processed MDCT coefficients is obtained by multiplying post-processed envelope with post-processed fine structure of MDCT coefficients.

In one embodiment of the present application, post-processing of MDCT coefficients is only applied to the high-band (4-8 KHz) and the low-band (0-4 KHz) is post-processed using a traditional time domain approach, where for the high-band, there is no LPC coefficients transmitted to the decoder. Since it would be too complicated to use the traditional time domain approach to perform the post-processing for the high-band, such embodiment of the present application utilizes available MDCT coefficients at the decoder to perform the post-processing.

In such embodiment, there may be 160 high-band MDCT coefficients, which can be defined by:

$$\hat{Y}(m),\ m=160,161\ldots,319 \qquad \text{Equation 5,}$$

where the high-band can be divided into 10 sub-bands, where each sub-band includes 16 MDCT coefficients, and where the 160 MDCT coefficients can be expressed as follows:

$$\hat{Y}^k(i)=\hat{Y}(160+k*16+i),\ k=0,1,\ldots 9;\ i=0,1,\ldots,15 \qquad \text{Equation 6,}$$

where k is a sub-band index, and i is the coefficient index within the sub-band.

Next, the magnitudes of the MDCT coefficients in each sub-band may be represented by:

$$Y^k(i)=|\hat{Y}^k(i)|\ k=0,1,\ldots,9;\ i=0,1,\ldots,15 \qquad \text{Equation 7,}$$

where the average magnitude in each sub-band is defined as the envelope:

$$ENV(k)=\sum_{i=0}^{15} Y^k(i),\ k=0,1,\ldots,9. \qquad \text{Equation 8}$$

As discussed above, the MDCT post-processing may be performed in two parts, where the first part may be referred to as envelope post-processing (corresponding to short-term post-processing) which modifies the envelope, and the second part that can be referred to as fine structure post-processing (corresponding to long-term post-processing) which enhances the magnitudes of each coefficients within each sub-band. In one aspect, MDCT post-processing further lowers the lower magnitudes, where the coding error is relatively more than the higher magnitudes. In one embodiment, an algorithm for modifying the envelope may be described as follows.

First, it is assumed that the maximum envelope value is:

$$MAXenv=MAX\{ENV(k),\ k=0,1,\ldots,9\} \qquad \text{Equation 9.}$$

Gain factors, which may be applied to the envelope, are calculated according to the following:

$$FAC1(k)=\alpha*\frac{ENV(k)}{MAXenv}+(1+\alpha),\ k=0,1,\ldots,9, \qquad \text{Equation 10}$$

where $\alpha$ ($0<\alpha<1$) is a constant for a specific bit rate; and the higher the bit rate, the smaller the constant $\alpha$. After determining the factors, the modified envelope can be expressed as:

$$ENV'(k)=g1*FAC1(k)*ENV(k),\ k=0,1,\ldots,9 \qquad \text{Equation 11,}$$

where g1 is a gain to maintain the overall energy, which is defined by:

$$g1=\frac{\sum_{k=0}^{9} ENV(k)}{\sum_{k=0}^{9} FAC1(k)*ENV(k)}. \qquad \text{Equation 12}$$

Next, for the second part, the fine structure modification within each sub-band may be similar to the above envelope post-processing, where it is assumed that the maximum magnitude value within a sub-band is:

$$\mathrm{MAX_Y}(k)=\mathrm{MAX}\{Y^k(i),\ i=0,1,2,\ldots,15\} \qquad \text{Equation 13,}$$

where gain factors for the magnitudes can be calculated as follows:

$$FAC2^k=\beta*\frac{Y^k(i)}{\mathrm{MAX_Y}(k)}+(1-\beta),\quad i=0,1,\ldots,15, \qquad \text{Equation 14}$$

where β (0<β<1) is a constant for a specific bit rate; and the higher the bit rate, the smaller the constant β. After determining the factors, the modified magnitudes can be defined as:

$$Y_1^k(i)=\mathrm{FAC2}^k(i)*Y^k(i),\ k=0,1,\ldots,9;\ i=0,1,\ldots,15 \qquad \text{Equation 15.}$$

By combining both the envelope post-processing and the fine structure post-processing, the final post-processed MDCT coefficients will be defined by:

$$\hat{Y}^k(i)=g1*\mathrm{FAC1}(k)*\mathrm{FAC2}^k(i)*\hat{Y}^k(i) \qquad \text{Equation 16,}$$

where k=0, 1, . . . , 9; and i=0, 1, . . . , 15.

Figure 5:
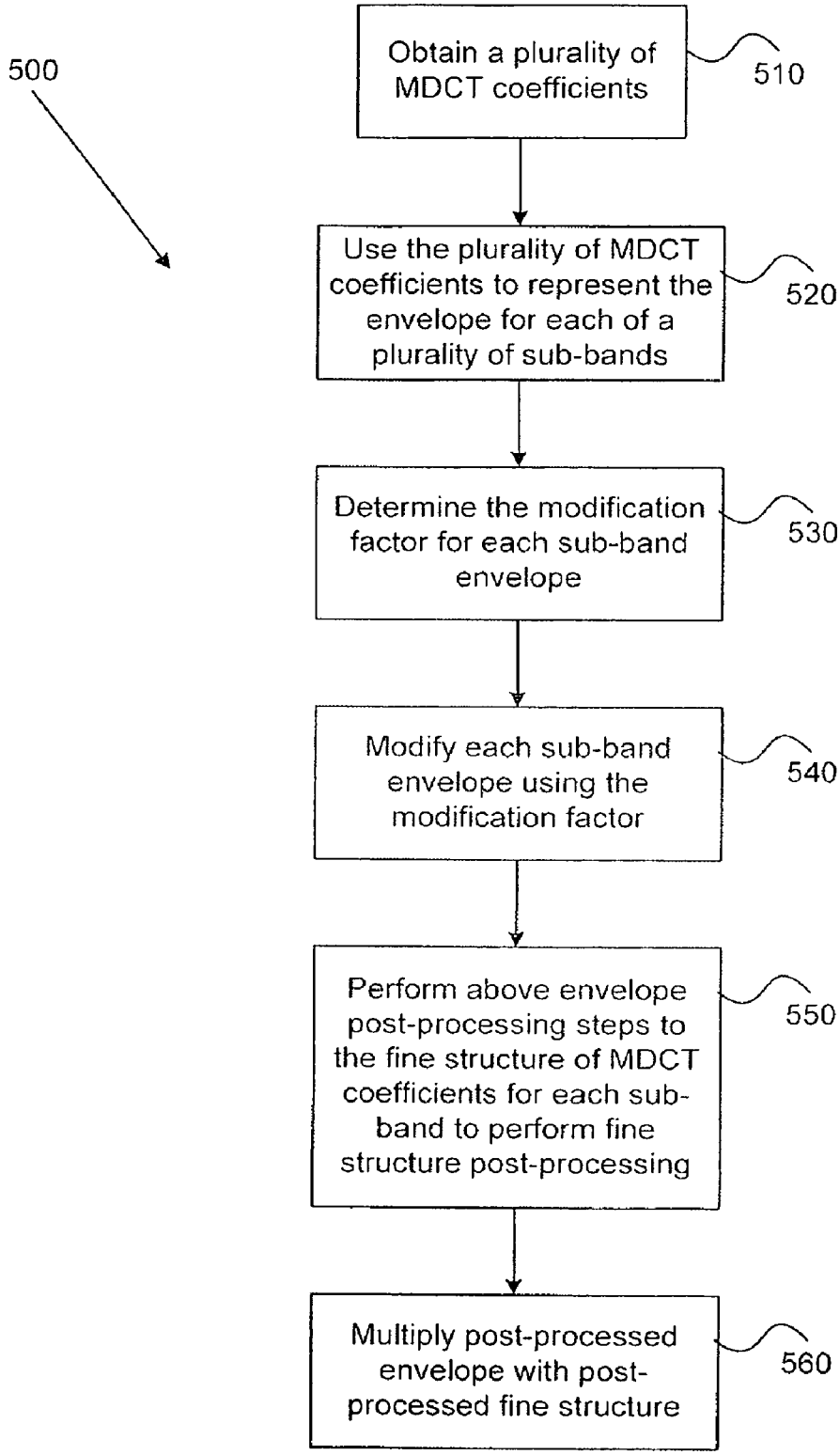
FIG. 5 illustrates a flow diagram for envelope and fine structure post-processing of the synthesized speech, according to one embodiment of the present invention.

FIG. 5 illustrates post-processing flow diagram 500 for envelope and fine structure post-processing of a synthesized speech, according to one embodiment of the present invention. Appendices A and B show an implementation of post-processing flow diagram 500 using "C" programming language in fixed-point and floating-point, respectively. As explained above, at the first step 510, post-processing flow diagram 500 obtains a plurality of MDCT coefficients either by calculating such coefficients or receiving them from another system component. Next, at step 520, post-processing flow diagram 500 uses the plurality of MDCT coefficients to represent the envelope for each of the plurality of sub-bands 330. In one embodiment, each sub-band will have one or more frequency coefficients, and for estimating the magnitude of each sub-band, a square-and-add operation is performed for every frequency of the sub-band to obtain the energy. In order to make the operation simpler, absolute values may be used for the computations.

At step 530, post-processing flow diagram 500 determines the modification factor for each sub-band envelope, for example, by using Equation 2, shown above. Next, at step 540, post-processing flow diagram 500 modifies each sub-band envelope using the modification factor of step 530, for example, by using Equation 3, shown above. At step 550, post-processing flow diagram 500 re-applies steps 510-540 for envelope post-processing (which can be analogized to short-term post-processing in time domain) to fine structures within each sub-band 430 for performing fine structure post-processing (which can be analogized to long-term post-processing in time domain.) Prior to performing the fine structure post-processing, post-processing flow diagram 500 may evaluate a fine structure of the MDCT coefficients through a division of the MDCT coefficients by the unmodified envelope coefficients, and then apply the process of steps 510-540 to the fine structure of the MDCT coefficients to each sub-band with different parameters. Further, at step 560, post-processing flow diagram 500 multiplies post-processed envelope with post-processed fine structure for reconstruction of the MDCT coefficients.

From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. For example, it is contemplated that the circuitry disclosed herein can be implemented in software, or vice versa. The described embodiments are to be considered in all respects as illustrative and not restrictive. It should also be understood that the invention is not limited to the particular embodiments described herein, but is capable of many rearrangements, modifications, and substitutions without departing from the scope of the invention.

APPENDIX A

```
/*****************************************************************************/
/*****************************************************************************/
/*                    Fixed-Point Post-Processing of TDAC (MDCT) Coefficients          */
/*****************************************************************************/
/*****************************************************************************/
/* Length of subnband */
#define    G729EV_MAIN_NB_SB_LEN    16
/*Number of subband */
#defineG729EV_MAIN_NB_SB_PST
(short)((G729EV_MAIN_L_FRAME/G729EV_MAIN_NB_SB_LEN)/2)
/* Simple post-processing of high-band TDAC coefficients for rate>=14kbps */
void
G729EV_TDAC_PostModify (Word16 *yq, Word16 n_yq, Word16 alfa)
{
  Word16 Max, alfa0, alfa1;
  Word16 temp, exp1, exp2;
  Word16 j;
  Max = 0;
  for (j = 0; j < n_yq; j++)
    {
      if (sub(yq[j], Max)>0)
        Max = yq[j];
    }
  Max=add(Max, 1);
  alfa1 = sub(32767, alfa);
  exp1 =norm_s(alfa);
```

APPENDIX A-continued

```
   exp1 =sub(exp1, 1);
   alfa=shl(alfa, exp1);
   exp2=norm_s(Max);
   Max=shl(Max, exp2);
   exp1 =sub(exp1, exp2);
   alfa0 = div_s(alfa, Max);
   for (j = 0; j < n_yq; j++)
      {
         temp = shr(mult_r(yq[j], alfa0), exp1);
         temp = add(temp, alfa1);
         yq[j] = mult_r(yq[j], temp);
      }
}
void
G729EV_TDAC_PostProcess (Word16 *ykr, Word16 nbyte)
{
   Word16EnvelopQ[G729EV_MAIN_NB_SB_PST],
EnvelopQ_P[G729EV_MAIN_NB_SB_PST];
   Word32 Mag0, Mag1;
   Word16 sign[G729EV_MAIN_L_FRAME/2];
   Word16 g, alfa, beta;
   Word16 i, j, i_s, rate_flag;
   Word32 L_tmp;
   Word16 temp, exp;
   alfa = 8192; //0.25
   beta = 9830; //0.3
   rate_flag = mult_r(shl(sub(nbyte, 35), 7), 26214);
   alfa = sub(alfa, rate_flag);
   beta = sub(beta, rate_flag);
   /* ---------------- Record sign ---------------- */
   for (j = 0; j < G729EV_MAIN_L_FRAME/2; j++)
      {
      sign[j] = 32767;
      if (ykr[j] < 0)
         {
          sign[j] = −32767;
          ykr[j] = negate(ykr[j]);
         }
      }
   /* ---------------------------------------------- */
   /* Envelope estimate and Post-processing          */
   /* ---------------------------------------------- */
   /* Envelope */
   i_s = 0;
   for (j = 0; j < G729EV_MAIN_NB_SB_PST; j++)
      {
      /* Envelope estimate */
      L_tmp = 1;
      for (i = i_s; i < i_s + G729EV_MAIN_NB_SB_LEN; i++)
         L_tmp = L_mac(L_tmp, 1, ykr[i]);
      EnvelopQ[j] = extract_1(L_shr(L_tmp, 4));
    i_s = add(i_s, (Word16)G729EV_MAIN_NB_SB_LEN);
   }
/* Post-processing */
Mag0 = 1;
for (j = 0; j < G729EV_MAIN_NB_SB_PST; j++)
   Mag0 = L_mac(Mag0, 1, EnvelopQ[j]);
for (j = 0; j < G729EV_MAIN_NB_SB_PST; j++)
   EnvelopQ_P[j] = EnvelopQ[j];
G729EV_TDAC_PostModify (EnvelopQ_P, (Word16)G729EV_MAIN_NB_SB_PST, alfa);
/* Energy compensation */
Mag1 = 1;
for (j = 0; i < G729EV_MAIN_NB_SB_PST; j++)
   Mag1 = L_mac(Mag1, 1, EnvelopQ_P[j]);
L_tmp = L_sub(Mag0, Mag1);
if (L_tmp>0) {
    exp=norm_1(Mag1);
    g=extract_h(L_shl(Mag1, exp));
    temp=extract_h(L_shl(L_tmp, exp));
    g=div_s(temp, g);
}
else g=0;
for (j = 0; j < G729EV_MAIN_NB_SB_PST; j++)
   EnvelopQ_P[j] = add(EnvelopQ_P[j], mult_r(g, EnvelopQ_P[j]));
/* Normalize */
for (j = 0; j < G729EV_MAIN_NB_SB_PST; j++) {
   if (sub(EnvelopQ_P[j], EnvelopQ[j])>=0) EnvelopQ_P[j]=32767;
   else EnvelopQ_P[j] = div_s(EnvelopQ_P[j], EnvelopQ[j]);
   }
```

APPENDIX A-continued

```
/* ---------------------------------------------- */
/* Fine structure post-processing                 */
/* ---------------------------------------------- */
i_s = 0;
for (j = 0; j < G729EV_MAIN_NB_SB_PST; j++)
   {
    G729EV_TDAC_PostModify (&ykr[i_s], (Word16)G729EV_MAIN_NB_SB_LEN, beta);
    i_s = add(i_s, (Word16)G729EV_MAIN_NB_SB_LEN);
   }
 /* ---------------------------------------------- */
 /*    Reconstruction                              */
 /* ---------------------------------------------- */
 i_s = 0;
 for (j = 0; j < G729EV_MAIN_NB_SB_PST; j++)
    {
     for (i = i_s; i < i_s + G729EV_MAIN_NB_SB_LEN; i++) {
          ykr[i] = mult_r(ykr[i], EnvelopQ_P[j]);
          ykr[i] = mult(ykr[i], sign[i]);
     }
     i_s = add(i_s, (Word16)G729EV_MAIN_NB_SB_LEN);
    }
 /* ---------------------------------------------- */
 return;
}
```

APPENDIX B

```
/*****************************************************************************/
/*****************************************************************************/
/*                    Floating-Point Post-Processing of TDAC (MDCT) Coefficients                    */
/*****************************************************************************/
/*****************************************************************************/
/* Length of subnband */
#define    G729EV_MAIN_NB_SB_LEN    16
/*Number of subband */
#defineG729EV_MAIN_NB_SB_PST
(short)((G729EV_MAIN_L_FRAME/G729EV_MAIN_NB_SB_LEN)/2)
void
G729EV_TDAC_PostModify (REAL * yq, INT16 n_yq, REAL alfa)
{
   REAL Max, alfa0, alfa1;
   INT16 j;
   Max = (REAL)1.0;
   for (j = 0; j < n_yq; j++)
      {
         if (yq[j] > Max)
            Max = yq[j];
      }
   alfa1 = 1 - alfa;
   alfa0 = alfa/Max;
   for (j = 0; j < n_yq; j++)
      {
         if (yq[j] < Max)
            yq[j] *= (yq[j] * alfa0 + alfa1);
      }
}
void
G729EV_TDAC_PostProcess (REAL * ykr, short nbyte)
{
   REALEnvelopQ[G729EV_MAIN_NB_SB_PST],
EnvelopQ_P[G729EV_MAIN_NB_SB_PST];
   INT16 sign[G729EV_MAIN_L_FRAME/2];
   REAL Mag0, Mag1, g, alfa, beta;
INT16 i, j, i_s, rate_flag;
alfa = (REAL)0.25;
beta = (REAL)0.3;
rate_flag = (nbyte - 35)/5;        /* 0:14kbps; 1:16kbps;...; 9:32kbps */
alfa -= rate_flag/(REAL)64.;
beta -= rate_flag/(REAL)64.;
/*
{
static short First=1;
if (First==1) {
                printf (" rate_flag = %d \n", rate_flag);
                First=0;
                }
```

APPENDIX B-continued

```
}
*/
/* ---------------- Record sign ---------------- */
for (j = 0; j < G729EV_MAIN_L_FRAME/2; j++)
  {
    sign[j] = 1;
    if (ykr[j] < 0)
      {
        sign[j] = −1;
        ykr[j] = −ykr[j];
      }
  }
/* ---------------------------------------------- */
/* Envelope estimate and Post-processing          */
/* ---------------------------------------------- */
/* Envelope */
i_s= 0;
for (j = 0; j < G729EV_MAIN_NB_SB_PST; j++)
  {
    /* Envelope estimate */
    EnvelopQ[j] = (REAL) 1.0;
    for (i = i_s; i < i_s + G729EV_MAIN_NB_SB_LEN; i++)
      EnvelopQ[j] += ykr[i];
    i_s += G729EV_MAIN_NB_SB_LEN;
  }
/* Post-processing */
Mag0 = (REAL)1.;
 for (j = 0; j < G729EV_MAIN_NB_SB_PST; j++)
   Mag0 += EnvelopQ[j];
 for (j = 0; j < G729EV_MAIN_NB_SB_PST; j++)
   EnvelopQ_P[j] = EnvelopQ[j];
 G729EV_TDAC_PostModify (EnvelopQ_P, G729EV_MAN_NB_SB_PST, alfa);
 /* Energy compensation */
 Mag1 = (REAL)1.;
 for (j = 0; j < G729EV_MAIN_NB_SB_PST; j++)
   Mag1 += EnvelopQ_P[j];
 g = Mag0/Mag1;
 for (j = 0; j < G729EV_MAIN_NB_SB_PST; j++)
   EnvelopQ_P[j] *= g;
 /* Normalize */
 for (j = 0; j < G729EV_MAN_NB_SB_PST; j++)
   EnvelopQ_P[j] /= EnvelopQ[j];
 /* ---------------------------------------------- */
 /* Fine structure post-processing                 */
 /* ---------------------------------------------- */
 i_s = 0;
 for (j = 0; j < G729EV_MAIN_NB_SB_PST; j++)
   {
     G729EV_TDAC_PostModify (&ykr[i_s], G729EV_MAIN_NB_SB_LEN, beta);
     i_s += G729EV_MAIN_NB_SB_LEN;
   }
 /* ---------------------------------------------- */
 /*    Reconstruction                              */
 /* ---------------------------------------------- */
 i_s = 0;
 for (j = 0; j < G729EV_MAIN_NB_SB_PST; j++)
   {
     for (i = i_s; i < i_s + G729EV_MAIN_NB_SB_LEN; i++)
       ykr[i] *= sign[i] * EnvelopQ_P[j];
     i_s += G729EV_MAIN_NB_SB_LEN;
   }
 /* ---------------------------------------------- */
 return;
}
```

What is claimed is:

1. A speech post-processing method for use by a speech post-processor to generate a post-processed speech signal, the speech post-processing method comprising:

decoding an encoded speech signal to obtain frequency domain coefficients representative of a speech signal divided into a plurality of sub-bands;

generating an envelope modification factor using the frequency domain coefficients;

generating a fine structure modification factor using the frequency domain coefficients;

determining a gain based on the envelope modification factor and an envelope;

modifying the frequency domain coefficients as a result of multiplying the frequency domain coefficients by the gain, the envelope modification factor and the fine structure modification factor to provide post-processed frequency domain coefficients; and generating the post-processed speech signal using the post-processed frequency domain coefficients;

wherein the determining the gain is based on:

$$g1 = \frac{\sum_{k=0}^{9} ENV(k)}{\sum_{k=0}^{9} FAC1(k) * ENV(k)}$$

where g1 is the gain, FAC1 is the envelope modification factor and ENV is the envelope.

2. A speech post-processing method for use by a speech post-processor to generate a post-processed speech signal, the speech post-processing method comprising:

decoding an encoded speech signal to obtain frequency domain coefficients representative of a speech signal divided into a plurality of sub-bands;

generating an envelope modification factor using the frequency domain coefficients;

generating a fine structure modification factor using the frequency domain coefficients;

determining a gain based on the envelope modification factor and an envelope;

modifying the frequency domain coefficients as a result of multiplying the frequency domain coefficients by the gain, the envelope modification factor and the fine structure modification factor to provide post-processed frequency domain coefficients; and generating the post-processed speech signal using the post-processed frequency domain coefficients;

wherein the generating the envelope modification factor uses:

$$FAC1=\alpha ENV/Max+(1-\alpha),$$

where FAC1 is the envelope modification factor, ENV is the envelope, Max is the maximum envelope, and $\alpha$ is a value between 0 and 1.

3. The speech post-processing method of claim 2, wherein $\alpha$ is a first constant value for a first speech coding rate ($\alpha$1), and $\alpha$ is a second constant value for a second speech coding rate ($\alpha$2), where the second speech coding rate is higher than the first speech coding rate, and $\alpha$1>$\alpha$2.

4. A speech post-processing method for use by a speech post-processor to generate a post-processed speech signal, the speech post-processing method comprising:

decoding an encoded speech signal to obtain frequency domain coefficients representative of a speech signal divided into a plurality of sub-bands;

generating an envelope modification factor using the frequency domain coefficients;

generating a fine structure modification factor using the frequency domain coefficients;

determining a gain based on the envelope modification factor and an envelope;

modifying the frequency domain coefficients as a result of multiplying the frequency domain coefficients by the gain, the envelope modification factor and the fine structure modification factor to provide post-processed frequency domain coefficients; and generating the post-processed speech signal using the post-processed frequency domain coefficients;

wherein the generating the fine structure modification factor uses:

$$FAC2=\beta MAG/Max+(1-\beta),$$

where FAC2 is the fine structure modification factor, MAG is a magnitude, Max is the maximum magnitude, and $\beta$ is a value between 0 and 1.

5. The speech post-processing method of claim 4, wherein $\beta$ is a first constant value for a first speech coding rate ($\beta$1), and $\beta$ is a second constant value for a second speech coding rate ($\beta$2), where the second speech coding rate is higher than the first speech coding rate, and $\beta$1>$\beta$2.

6. A speech post-processor for generating a post-processed speech signal, the speech post-processor comprising:

software and circuitry for providing:

a decoder configured to decode an encoded speech signal to obtain frequency domain coefficients representative of a speech signal divided into a plurality of sub-bands;

an envelope modification factor generator configured to use the frequency domain coefficients for generating an envelope modification factor;

a fine structure modification factor generator configured to use the frequency domain coefficients for generating a fine structure modification factor;

wherein speech post-processor is configured to determine a gain based on the envelope modification factor and an envelope, and further configured to modify the frequency domain coefficients as a result of multiplying the frequency domain coefficients by the gain, the envelope modification factor and the fine structure modification factor to provide post-processed frequency domain coefficients, and further configured to generate the post-processed speech signal using the post-processed frequency domain coefficients;

wherein the speech post-processor determines the gain according to:

$$g1 = \frac{\sum_{k=0}^{9} ENV(k)}{\sum_{k=0}^{9} FAC1(k) * ENV(k)}$$

where g1 is the gain, FAC1 is the envelope modification factor and ENV is the envelope.

7. A speech post-processor for generating a post-processed speech signal, the speech post-processor comprising:

software and circuitry for providing:

a decoder configured to decode an encoded speech signal to obtain frequency domain coefficients representative of a speech signal divided into a plurality of sub-bands;

an envelope modification factor generator configured to use the frequency domain coefficients for generating an envelope modification factor;

a fine structure modification factor generator configured to use the frequency domain coefficients for generating a fine structure modification factor;

wherein speech post-processor is configured to determine a gain based on the envelope modification factor and an envelope, and further configured to modify the frequency domain coefficients as a result of multiplying the frequency domain coefficients by the gain, the envelope modification factor and the fine structure modification factor to provide post-processed frequency domain coefficients, and further configured to generate the post-processed speech signal using the post-processed frequency domain coefficients;

wherein the envelope modification factor generator generates the envelope modification factor using:

$$FAC1=\alpha ENV/Max+(1-\alpha),$$

where FAC1 is the envelope modification factor, ENV is the envelope, Max is the maximum envelope, and $\alpha$ is a value between 0 and 1.

8. The speech post-processor of claim 7, wherein $\alpha$ is a first constant value for a first speech coding rate ($\alpha$1), and $\alpha$ is a second constant value for a second speech coding rate ($\alpha$2), where the second speech coding rate is higher than the first speech coding rate, and $\alpha$1>$\alpha$2.

9. A speech post-processor for generating a post-processed speech signal, the speech post-processor comprising:

software and circuitry for providing:

a decoder configured to decode an encoded speech signal to obtain frequency domain coefficients representative of a speech signal divided into a plurality of sub-bands;

an envelope modification factor generator configured to use the frequency domain coefficients for generating an envelope modification factor;

a fine structure modification factor generator configured to use the frequency domain coefficients for generating a fine structure modification factor;

wherein speech post-processor is configured to determine a gain based on the envelope modification factor and an envelope, and further configured to modify the frequency domain coefficients as a result of multiplying the frequency domain coefficients by the gain, the envelope modification factor and the fine structure modification factor to provide post-processed frequency domain coefficients, and further configured to generate the post-processed speech signal using the post-processed frequency domain coefficients;

wherein the fine structure modification factor generator generates the fine structure modification factor using:

$$FAC2=\beta MAG/Max+(1-\beta),$$

where FAC2 is the fine structure modification factor, MAG is a magnitude, Max is the maximum magnitude, and $\beta$ is a value between 0 and 1.

10. The speech post-processor of claim 9, wherein $\beta$ is a first constant value for a first speech coding rate ($\beta$1), and $\beta$ is a second constant value for a second speech coding rate ($\beta$2), where the second speech coding rate is higher than the first speech coding rate, and $\beta$1>$\beta$2.

* * * * *